US005363076A

United States Patent [19]

Miller et al.

[11] Patent Number: 5,363,076

[45] Date of Patent: Nov. 8, 1994

[54] CIRCUIT BREAKER HAVING SPRING BIASED BLADE SUSPENSION

[75] Inventors: Joel L. Miller, Cedar Rapids; Teresa I. Hood, Coralville; John M. Winter, Cedar Rapids, all of Iowa

[73] Assignee: Square D Company, Palatine, Ill.

[21] Appl. No.: 54,360

[22] Filed: Apr. 28, 1993

[51] Int. Cl.[5] ..... H01H 75/00

[52] U.S. Cl. ..... 335/16; 335/147; 200/147 R

[58] Field of Search ..... 335/16, 147, 195; 200/147 R

[56] References Cited

U.S. PATENT DOCUMENTS

| | | | |
|---|---|---|---|
| 4,540,961 | 9/1985 | Maier . | |
| 4,635,011 | 1/1987 | Leone et al. . | |
| 4,841,266 | 6/1989 | Wulff | 335/16 |
| 4,845,459 | 7/1989 | Manthe et al. | 335/195 |

*Primary Examiner*—Lincoln Donovan

*Attorney, Agent, or Firm*—Larry I. Golden; Kareem M. Irfan

[57] ABSTRACT

A blade suspension assembly for a circuit breaker includes a first electrical contact, an elongated contact arm having a second electrical contact adjacent a first end of the contact arm, a compression spring, and an elongated lever. The second electrical contact is movable about a first pivot axis between a contacts-closed position and at least one contacts-open position with respect to the first electrical contact. The lever has a first end adjacent a second pivot axis, a second end supported by the compression spring, and a contoured support surface between the first and second ends which supports a second end of the contact arm. The compression spring exerts a force against the second end of the lever so that the contoured support surface biases the second end of the contact arm about the first pivot axis in the contacts-closed position during normal operation and in the contacts-open position in response to the contact arm moving to the contacts-open position.

19 Claims, 9 Drawing Sheets

216
200
112
124
102
10
18
212
80
208
210
204
26
84
82
30
206
202
222
220
214
224

CIRCUIT BREAKER HAVING SPRING BIASED BLADE SUSPENSION

FIELD OF THE INVENTION

The present invention generally relates to circuit breakers, and more particularly, to a spring-biased blade suspension circuit breaker structure which provides improvements in terms of operation, ease of manufacturing and assembly, and reliability.

BACKGROUND OF THE INVENTION

Circuit breakers are commonly used for providing automatic circuit interruption upon detection of undesired overcurrent conditions on the circuit being monitored. These overcurrent conditions include, among others, overload conditions, ground faults and short-circuit conditions.

Circuit breakers typically include an electrical contact on a movable arm which rotates away from a fixed contact in order to "break" the current path. The type of overcurrent condition dictates how quickly the arm must rotate. For example, in response to overcurrent conditions at relatively low magnitudes but present for a long period of time, circuit breakers generally move the arm to break the current path by tripping a spring-biased latch mechanism which forces the contact on the arm away from the fixed contact. Spring-biased latch mechanisms are usually relatively slow. In response to overcurrent conditions at relatively high magnitudes, circuit breakers must break (or blow-open) the current path very quickly, reacting much faster than the reaction time for known spring-biased latch mechanisms. In either case, the contact arm must rotate to an open position as fast, as simply and as reliably as possible.

Circuit breaker designs attempting to achieve these objectives of quickness and reliability have failed. For example, most circuit-breaker blade suspension mechanisms require complex manual assembly involving high part count, intricate positioning of one or more drive pins and one or more torsion springs for biasing movable arms, and their overall intricate assembly prohibits late point assembly adjustments, field adjustment and/or service. In addition, the complex design of most circuit-breaker blade suspension mechanisms is not conducive to straight-pull molding techniques during manufacturing.

Many conventional circuit-breaker blade suspension mechanisms also exhibit problems in terms of their operation. These problems include slow contact arm rotation, the contact arm rebounding to the closed-contact position during interruption, breakage of the crossbar used to support the contact arm, and inconsistent contact force characteristics.

Generally, the speed and reliability at which the blade suspension mechanism breaks the current path is directly related to the complexity of the blade suspension mechanism, i.e., the faster the mechanism and the higher its reliability, the more complex the mechanism.

Accordingly, there is a need for a circuit breaker having a blade suspension mechanism which overcomes the above-mentioned deficiencies of the prior art.

SUMMARY OF THE INVENTION

The present invention provides a circuit-breaker blade suspension assembly including a first electrical contact, an elongated contact arm with opposing ends, an elongated lever with opposing ends, and a spring. One end of the contact arm includes a second electrical contact which rotates about a pivot axis between a contacts-closed position and at least one contacts-open position with respect to the first electrical contact. The lever has a contoured surface between its opposing ends for supporting the contact arm adjacent to the other end of the contact arm. The spring applies forces against one end of the lever which serve to bias the contact arm in both the contacts-closed position and the contacts-open position.

BRIEF DESCRIPTION OF THE DRAWINGS

Other objects and advantages of the invention will become apparent upon reading the following detailed description and upon reference to the drawings in which.

Figure 1A:
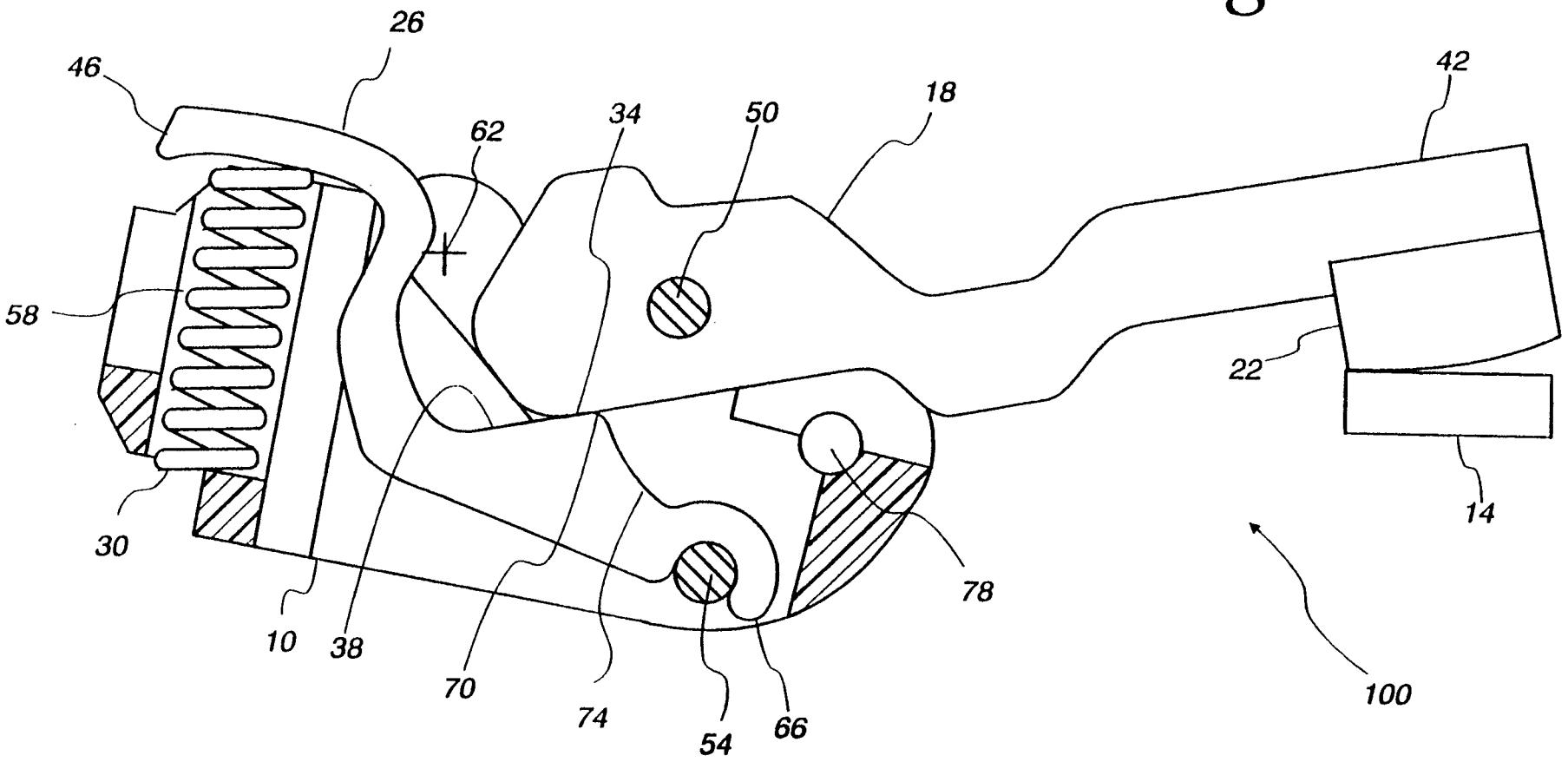
FIGS. 1*a* through 1*c* are cross-section views of one pole of a three-pole blade (or contact arm) suspension mechanism, according to the present invention, respectively showing an "on" position (FIG. 1*a*), a tripped position (FIG. 1*b*) and a blown-open position (FIG. 1*c*)

While the invention is susceptible to various modifications and alternative forms, specific embodiments thereof have been shown by way of example in the drawings and will be described in detail. It should be understood, however, that the described embodiments are not intended to limit the invention to the particular form described. On the contrary, the intention is to cover all modifications, equivalents, and alternatives falling within the spirit and scope of the invention as defined by the appended claims.

DETAILED DESCRIPTION OF THE PREFERRED EMBODIMENT

Figure 1B:
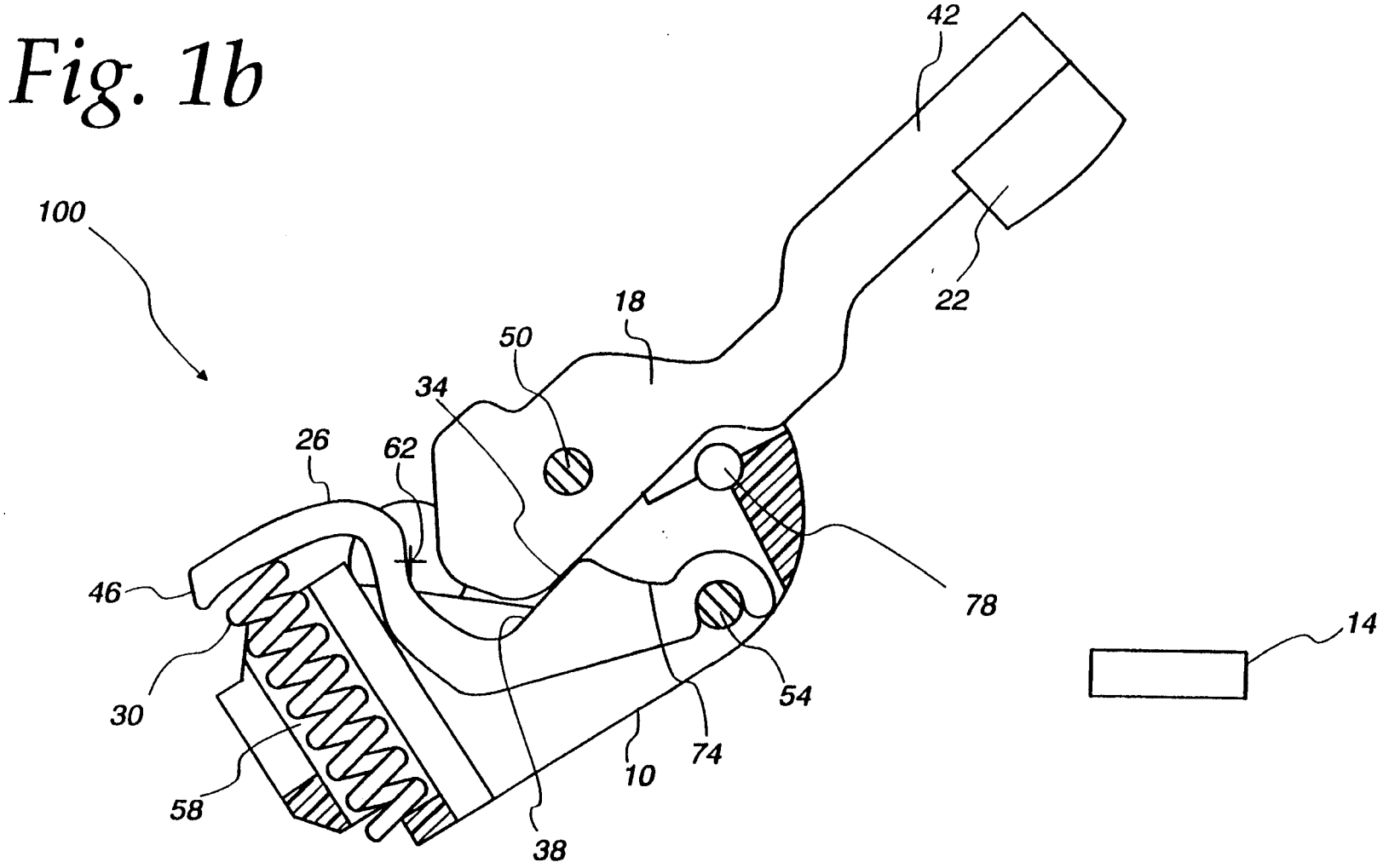
Figure 1C:
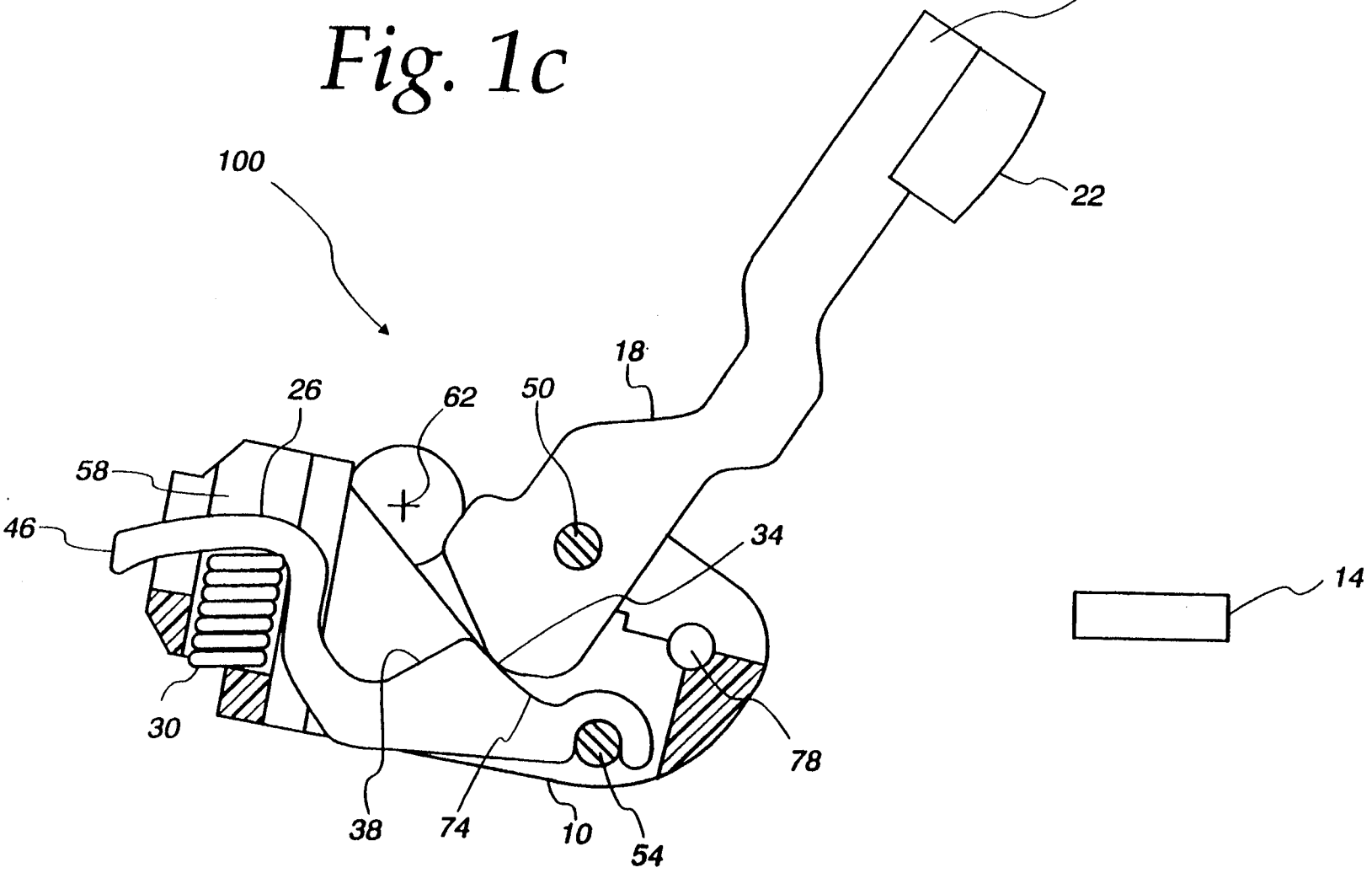

Turning now to the drawings, FIGS. 1*a* through 1*c* show cross-section views of a blade suspension mechanism, according to the present invention, in the "on", untripped or "closed" position (FIG. 1*a*), the "off" or tripped position (FIG. 1*b*) in which the entire housing 10 is rotated away from the fixed electrical contact 14, and the blown-open position (FIG. 1*c*) in which the elongated contact arm 18 is rotated away from the fixed electrical contact 14. A significant advantage of this blade suspension in a circuit breaker structure is that it provides remarkable quickness and reliability while avoiding the complexity typically associated with previously designed circuit breakers attempting to achieve such performance.

More specifically, FIG. 1*a* depicts the primary components of the inventive blade suspension mechanism comprising a housing 10, an elongated contact arm 18 incorporating a movable electrical contact 22, a lever 26, a compression spring 30, and a fixed electrical contact 14. The elongated contact arm 18 has a spring-loaded end 34 resting on a first contoured area 38 of the lever 26 and a contact end 42 to which the electrical contact 22 is attached. The spring end 46 of the lever 26 is supported by the compression spring 30. The elongated contact arm 18 via pivotal pin 50, the lever 26 via pivot 54, and the compression spring 30 via a spring compartment 58 are all secured by the housing 10. This housing 10 pivots around a third point 62 (FIG. 1*c*).

The compression spring 30 is used to reduce complexity while at the same time to enhance the consistency of the interaction between electrical contacts 14 and 22. This is accomplished by pivoting the elongated contact arm 18 around a pin 50 with the lever 26 reacting to the spring force such that the force is used to bias the elongated contact arm 18 in both the closed and blown-open position.

In the "on" position as shown in FIG. 1*a*, the compression spring 30 exerts a torque upon the lever 26 at its spring end 46 forcing the pivotal end 66 of the lever 26 to rotate about pivot 54. The first contoured area 38 of the lever 26 exerts a force in a direction substantially parallel to that exerted by the compression spring 30 which in turn biases the elongated contact arm 18 in the on position.

The elongated contact arm 18 moves from the "on" position to the blown-open position by rotating around pivotal point 50 in response to a repulsive force which develops between electrical contacts 14 and 22 during overcurrent conditions of relatively high magnitudes. The magnitude of the overcurrent condition must be high enough to obtain a contact constriction resistance force, and a blow-off force large enough to overcome the forces exerted by the compression spring 30 and the first contoured area 38 of the lever 26. Provided that such forces are present, the spring-loaded end 34 of the elongated contact arm 18 moves over the ridge 70 which exists between contoured areas 38 and 74 of the lever 26 causing the spring end 46 of the lever 26 to penetrate the spring compartment 58 of the housing 10 thereby increasing the compression of the compression spring 30 until the lever 26 exerts a force which is directed near or through the pivotal pin 50 of the contact arm 18 and maintaining the elongated contact arm 18 in the position shown in FIG. 1*c*. In this manner, the tendency of the elongated contact arm 18 to rebound to the closed or on position is minimized. More specifically, the quickness of the pivotal movement of the elongated contact arm 18, the resistive forces between the contoured surface 74 of the lever 26 and the spring-loaded end 34 of the elongated contact arm 18, and the ridge 70 of the lever 26 work in conjunction with each other to prevent the contact arm 18 from rebounding to a closed position.

While in the blown-open position as shown in FIG. 1*c*, the compression spring 30 maintains a torque upon the lever 26 at its spring end 46. The lever's second contoured area 74 is shaped to exert an upward force on the spring-loaded end 34 of the contact arm 18 to secure the elongated contact arm 18 in an open position whereby the electrical contact 22 is separated from the fixed electrical contact 14. The force exerted by the lever 26 on the contact arm 18 in the blown-open position is essentially through the pivotal point 50, thus eliminating any moment arm and torque which would cause the arm 18 to rotate to the contacts-closed position.

Accordingly, the arrangement of the compression spring 30, the lever 26, and the elongated contact arm 18 simplifies the construction of the circuit breaker by allowing the elongated contact arm 18 to be maintained reliably in both open and closed positions. As a result of the dual use of the single lever 26, complexity is reduced with corresponding benefits in terms of assembly and service and speed while reliability is enhanced.

In the tripped position as shown in FIG. 1*b*, the entire housing 10 is rotated around the pivot 62, and the electrical contacts 14 and 22 are separated. The housing rotates to the tripped position as a result of an upward force being applied to the housing drive pin 78 after the mechanism has been tripped.

Figure 2:
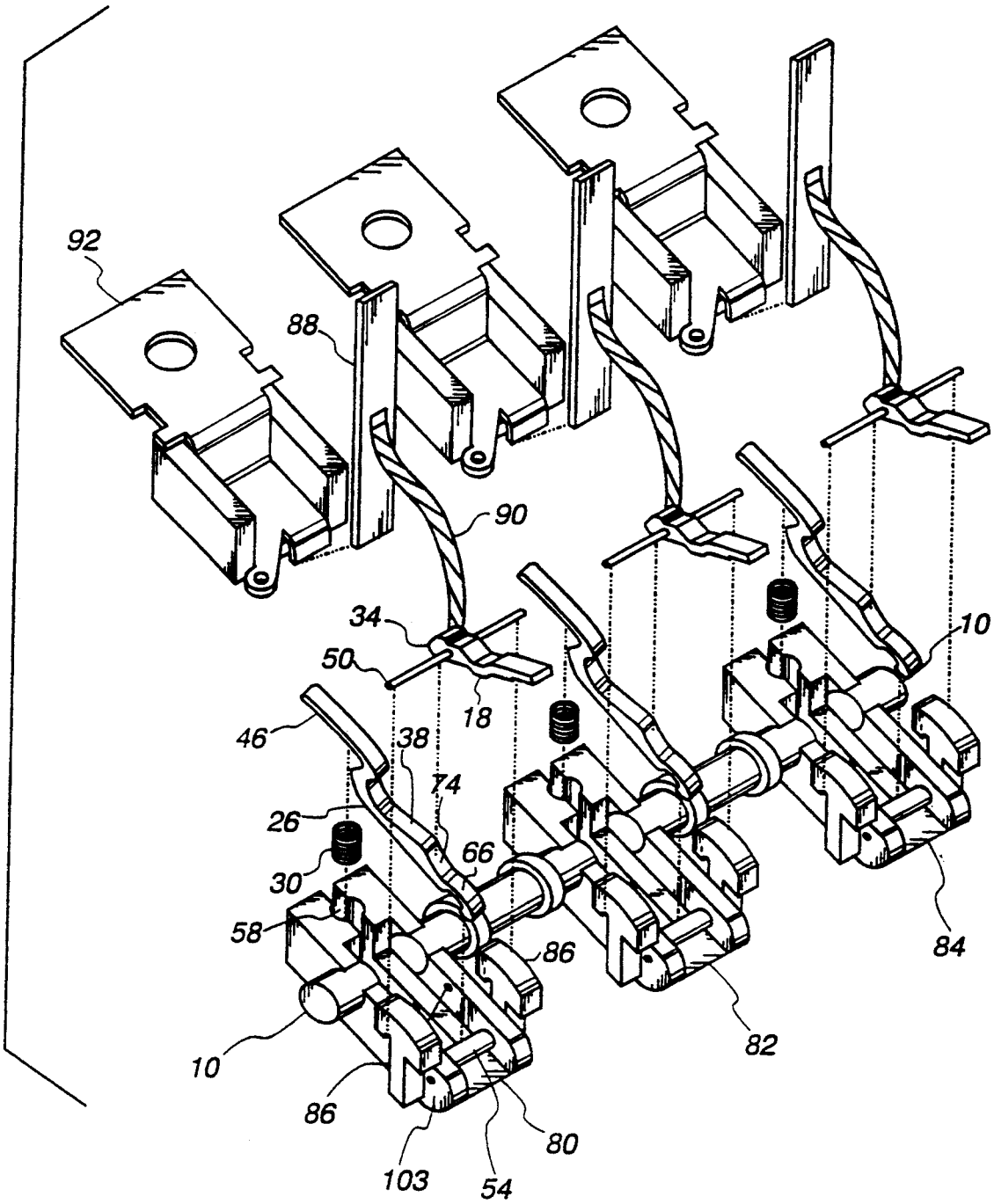
FIG. 2 is a perspective view of the Z-axis assembly of a three-pole blade suspension mechanism and a portion of a tripping mechanism, each pole of the blade suspension mechanism being constructed as shown in FIGS. 1*a* through 1*c;*

FIG. 2 is a perspective view illustrating the Z-axis assembly of the blade suspension mechanism 100 of FIGS. 1*a* through 1*c* and a portion of a tripping mechanism. The illustrated housing 10 includes three pole sections 80, 82, 84, each pole section being associated with a separate pole of a three-pole circuit breaker. Each pole section is adapted to receive its own blade suspension mechanism, which is substantially identical to the blade suspension mechanisms received by the other two pole sections.

The housing 10 is constructed to support the structural integrity of three blade suspension mechanisms. The housing 10 is preferably molded as a single piece so as to overcome deficiencies associated with previous circuit breakers such as high part count, pivotal pins which are subject to breakage, complicated geometries, and insulating ability, resulting in these previous breakers having an increased cost of manufacture and assembly. The particular housing 10 of FIG. 2 also has the benefits of being conducive to the use of straight pull molding techniques which is beneficial in terms of manufacture, assembly, and service.

The assembly of the blade suspension mechanism 100 associated with the pole section 80 in FIG. 2 will now be described. The assembly of the remaining two blade suspension mechanisms in FIG. 2 is accomplished in the same manner. The compression spring 30 is first installed in the spring compartment 58 of the housing 10. Next, the lever 26 is installed with the spring end 46 of the lever 26 resting on the compression spring 30 and the pivotal end 66 positioned at the pivot 54 formed from the housing 10. Finally, the contact arm 18 is installed with the spring-loaded end 34 resting on one of the contoured areas 38, 74 of the lever 26 and with the pivotal pin 50 secured at location 86 of the housing 10. Although the contact arm 18 in FIG. 2 is shown to be installed with the spring-loaded end 34 resting on the second contoured area 74, it would also be proper to install the contact arm 18 with the spring-loaded end 34 resting on the first contoured area 38.

FIG. 2 further illustrates the assembly of other parts used in the circuit-breaker tripping mechanism. In particular, the contact arm 18 is connected to a bimetal 88 via a pigtail or flexible connector 90. The pigtail 90 connects the end 34 of the contact arm 18 to the middle portion of the bimetal 88. In addition, the lower end of the bimetal 88 is rigidly attached to a load terminal 92. As will be discussed later, the bimetal 88 aids in tripping the circuit breaker in an overload situation.

Figure 3:
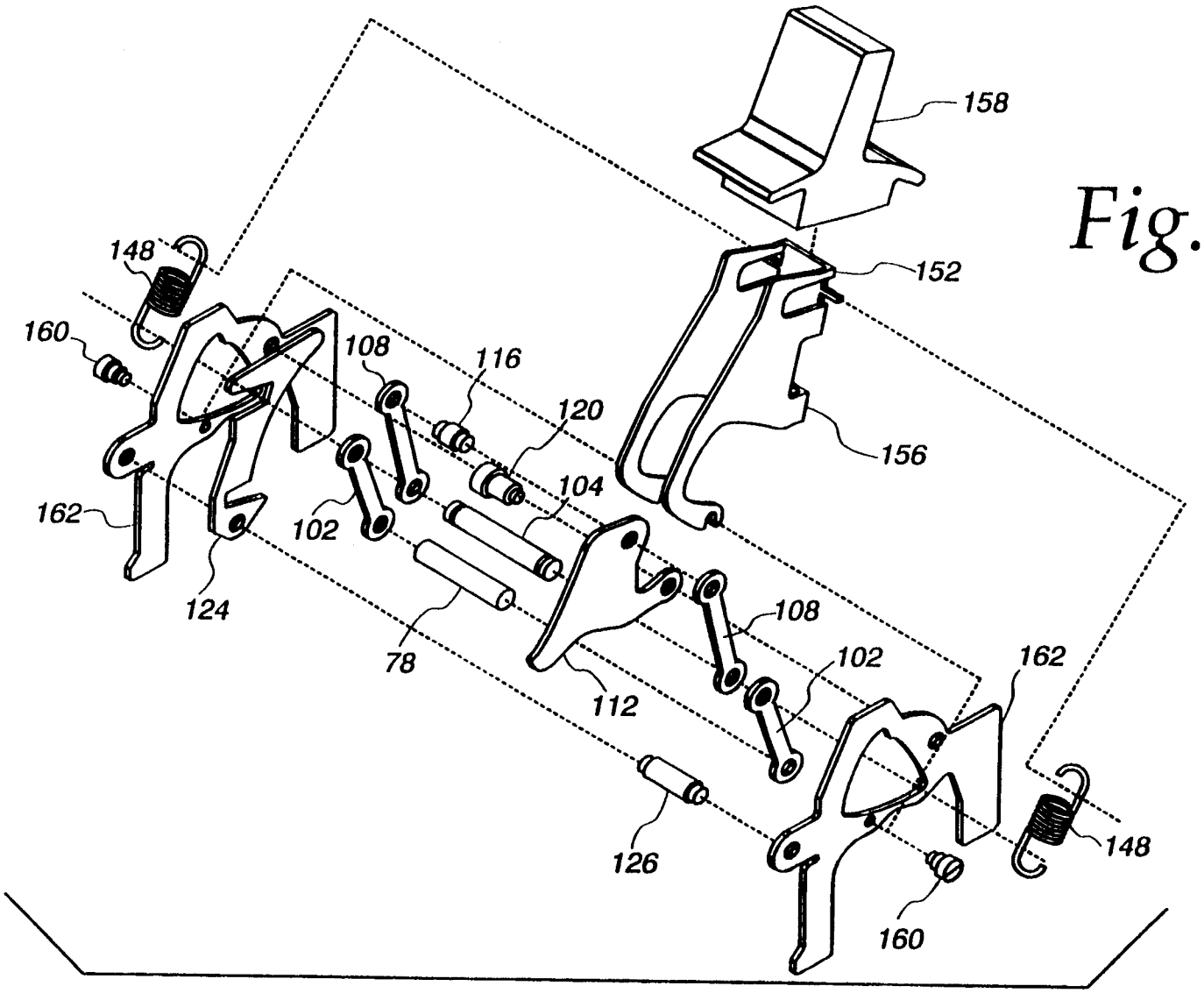
FIG. 3 is a perspective view of a spring-biased latch mechanism, which is constructed and arranged to incorporate a one, two, or three pole blade suspension mechanism assembled similar to the three-pole blade suspension mechanism shown in FIG. 2.

FIG. 3 is a perspective view illustrating a circuit-breaker spring-biased latch mechanism, which is constructed and arranged to incorporate a one, two, or three pole blade suspension mechanism 100 assembled in accordance with FIG. 2. There is a one pole, two pole, or three pole blade suspension mechanism per circuit breaker, depending on whether the circuit breaker has one, two, or three poles. In a three-pole circuit-breaker, the spring-biased latch mechanism is connected to a three-pole blade suspension mechanism as shown in FIG. 4.

The spring-biased latch mechanism shown in FIG. 3 is connected to the housing 10 shown in FIG. 2 by connection of lower links 102 to the housing 10 at location 103 via the housing drive pin 78. The lower links 102 are attached at their other end to a toggle pin 104. Upper links 108 are connected to the lower links 102 via the toggle pin 104. The upper links 108 in turn are connected to a cradle 112 via an upper link cradle pin 116. The cradle 112 is rotatable around a cradle pivot pin 120, which is attached to a frame 162. A latch 124 is contoured to engage the cradle 112 in two locations, AA and BB, when in the untripped position. The latch 124 is rotatable around a latch pivot pin 126, which is attached to the frame 162. A latch plate (see FIG. 5) maintains the latch 124 in its untripped position by engaging the latch 124 at point 144 (see FIG. 5). Two springs 148 bias the toggle pin 104 upwards by connection to a handle end 152 of a handle arm 156. The handle arm 156 is rotatably attached to the frame 162 by the handle arm pin 160, and the latch 124 is pivotally attached to the frame 162 by a latch pivot pin 126. The handle arm 156 is connected to a handle 158 so that the pole of the circuit breaker may be manually reset to the untripped position by movement of the handle.

Figure 4:
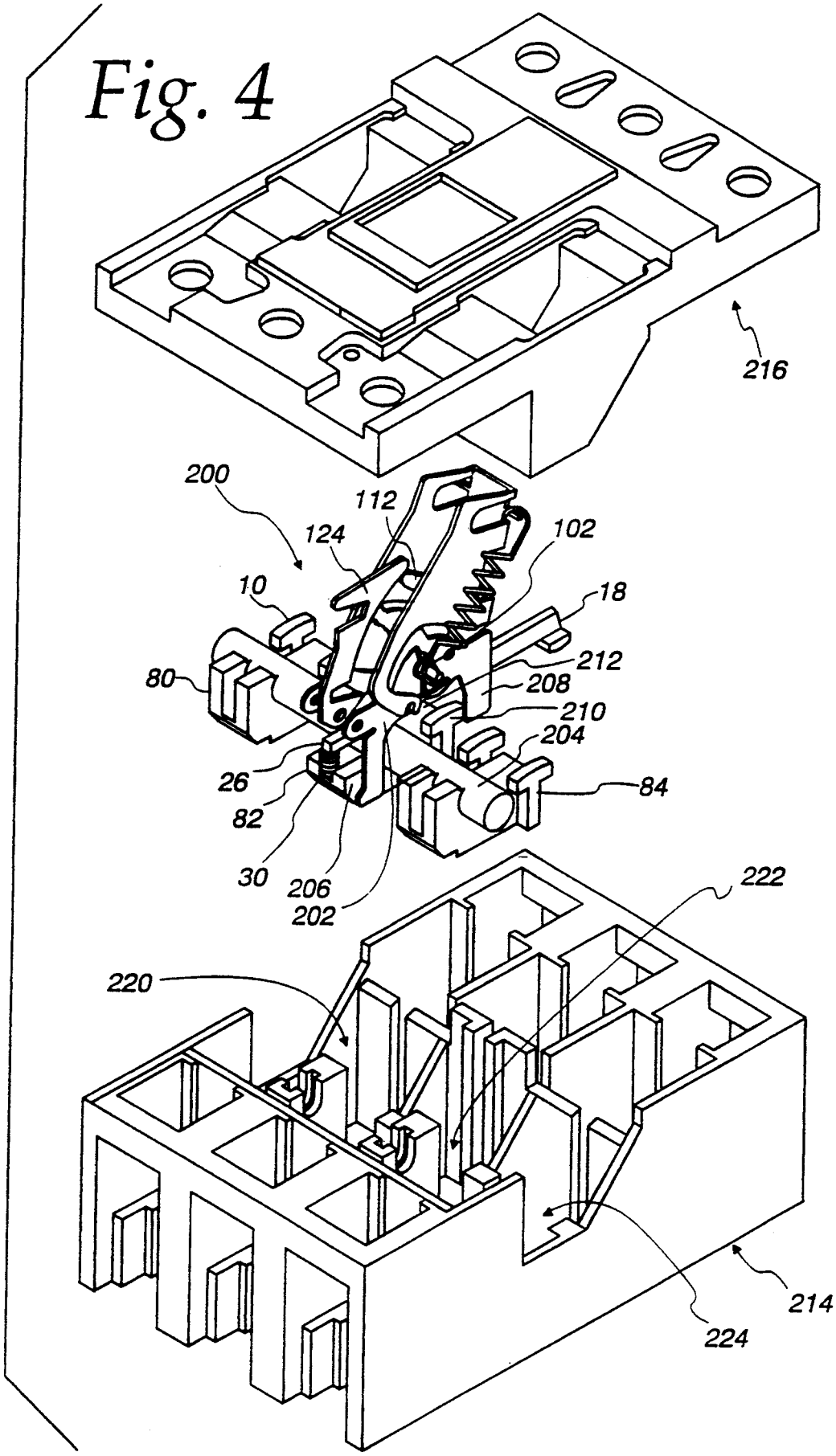
FIG. 4 is a perspective view of the spring-biased latch mechanism shown in FIG. 3, with the blade suspension mechanism in FIG. 2 contained therein, and an enclosure constructed to receive the spring-biased latch mechanism.

FIG. 4 illustrates the spring-biased latch mechanism shown in FIG. 3 combined with the blade suspension mechanism 100 shown in FIG. 2 (without the bimetal 88, the pigtail 90, and the load terminal 92). To incorporate the blade suspension mechanism 100 within the spring-biased latch mechanism, the blade suspension mechanism 100 is first installed in the housing 10 as described in connection with FIG. 2. The spring-biased latch mechanism is next installed over the blade suspension mechanism 100 such that the contact arm 18 and the lever 26 are transversely (horizontally) aligned between the lower links 102. The contact arm 18, the lever 26, and the compression spring 30 are vertically positioned below the latch 124 and the cradle 112, but in transverse alignment with the latch 124 and the cradle 112.

As shown in FIG. 4, a first portion 202 of the frame 162 of the spring-biased latch mechanism rests over a housing cross-bar 204, the first frame portion 202 being transversely positioned to the outside of the housing portion 206. Moreover, a second frame portion 208 rests over housing sections 210, the second frame portion 208 being transversely positioned adjacent to the outside walls of the housing portion 212.

FIG. 4 further illustrates an enclosure comprised of a base piece 214 and a cover piece 216. The enclosure includes three compartments 220, 222, 224 which are adapted to receive the three pole sections 80, 82, 84 of the housing 10, the associated blade suspension mechanisms, and the spring-biased latch mechanism. The enclosure depicted in FIG. 4 is adapted to receive the pole section 82, the associated blade suspension mechanism 100, and the spring-biased latch mechanism in the second compartment 222.

Figure 5:
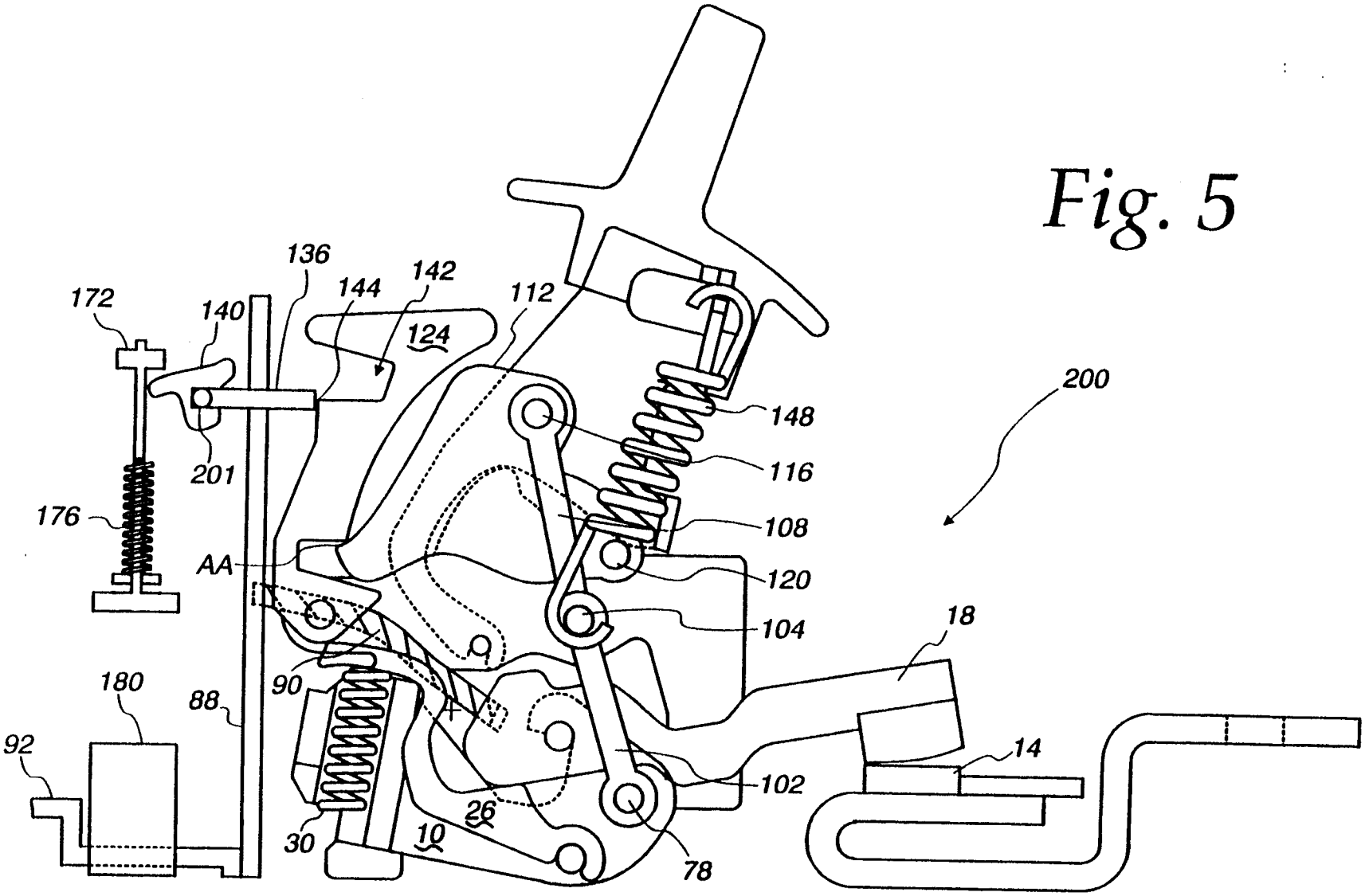
FIG. 5 is a side view of a tripping mechanism shown in the "on", untripped or closed position, the tripping mechanism incorporating the spring-biased latch mechanism in FIG. 3, the blade suspension mechanism in FIG. 2, and the tripping mechanism portion in FIG. 2.

FIG. 5 is a side view of a tripping mechanism 200 shown in an untripped position, the tripping mechanism 200 incorporating the spring-biased latch mechanism in FIG. 3, the blade suspension mechanism in FIG. 2, and the tripping mechanism portion in FIG. 2. As previously discussed, the tripping mechanism portion in FIG. 2 includes the bimetal 88, the pigtail 90, and the load terminal 92. The bimetal 88 is attached to the contact arm 18 via the pigtail 90, and the load terminal 92 is attached to the lower end of the bimetal 88. Furthermore, a latch plate 136, which is fixedly attached to a rotatable trip cross-bar 140, maintains the latch 124 in an untripped position by engaging the latch 124 at point 144. A magnetic armature 172 is biased upward by a spring 176, and is adapted to be pulled down toward a yoke 180 due to a high magnetic field around the yoke 180 in a short-circuit condition.

Figure 6:
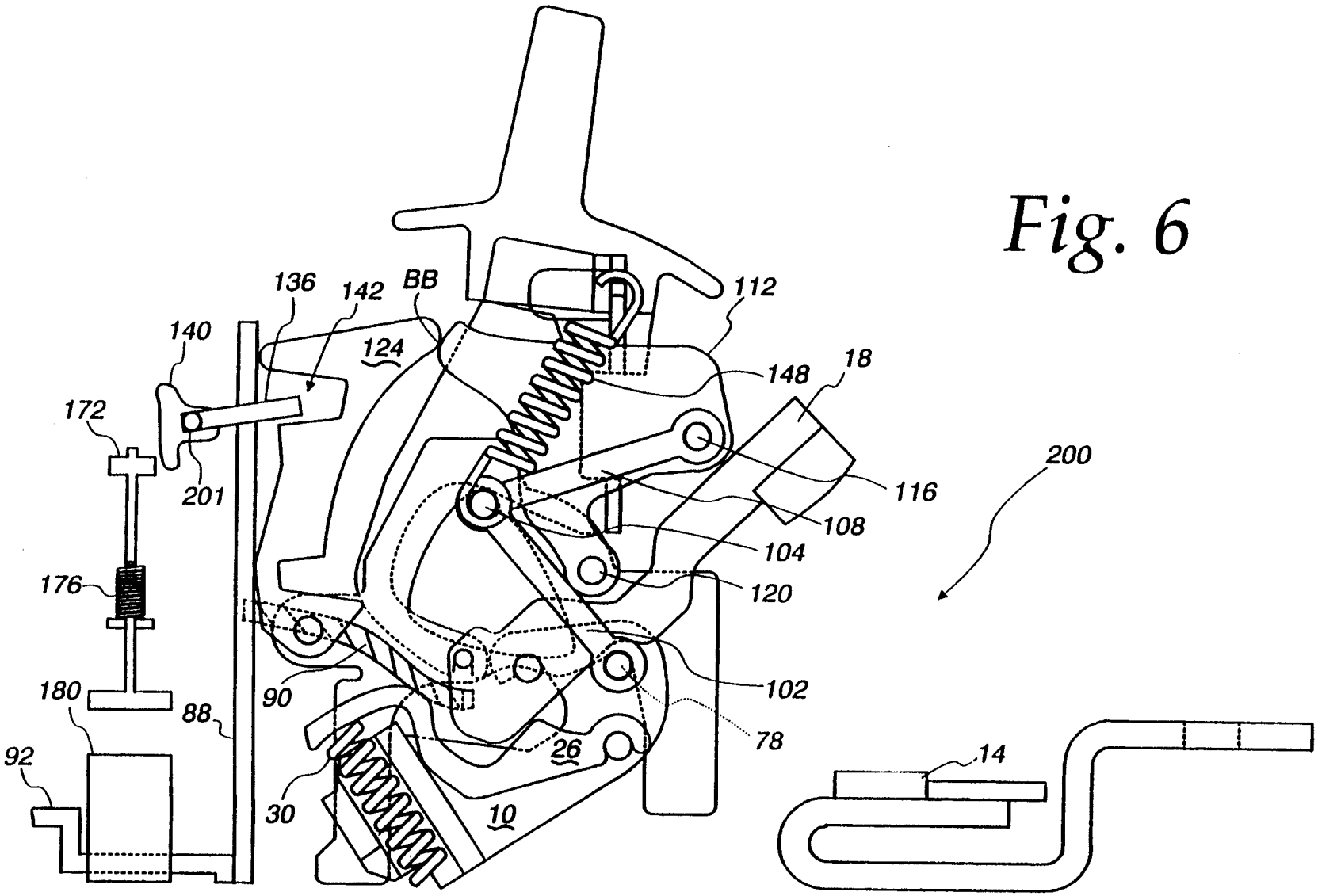
FIG. 6 is a side view of a tripping mechanism shown in the "off" or tripped position.
Figure 7:
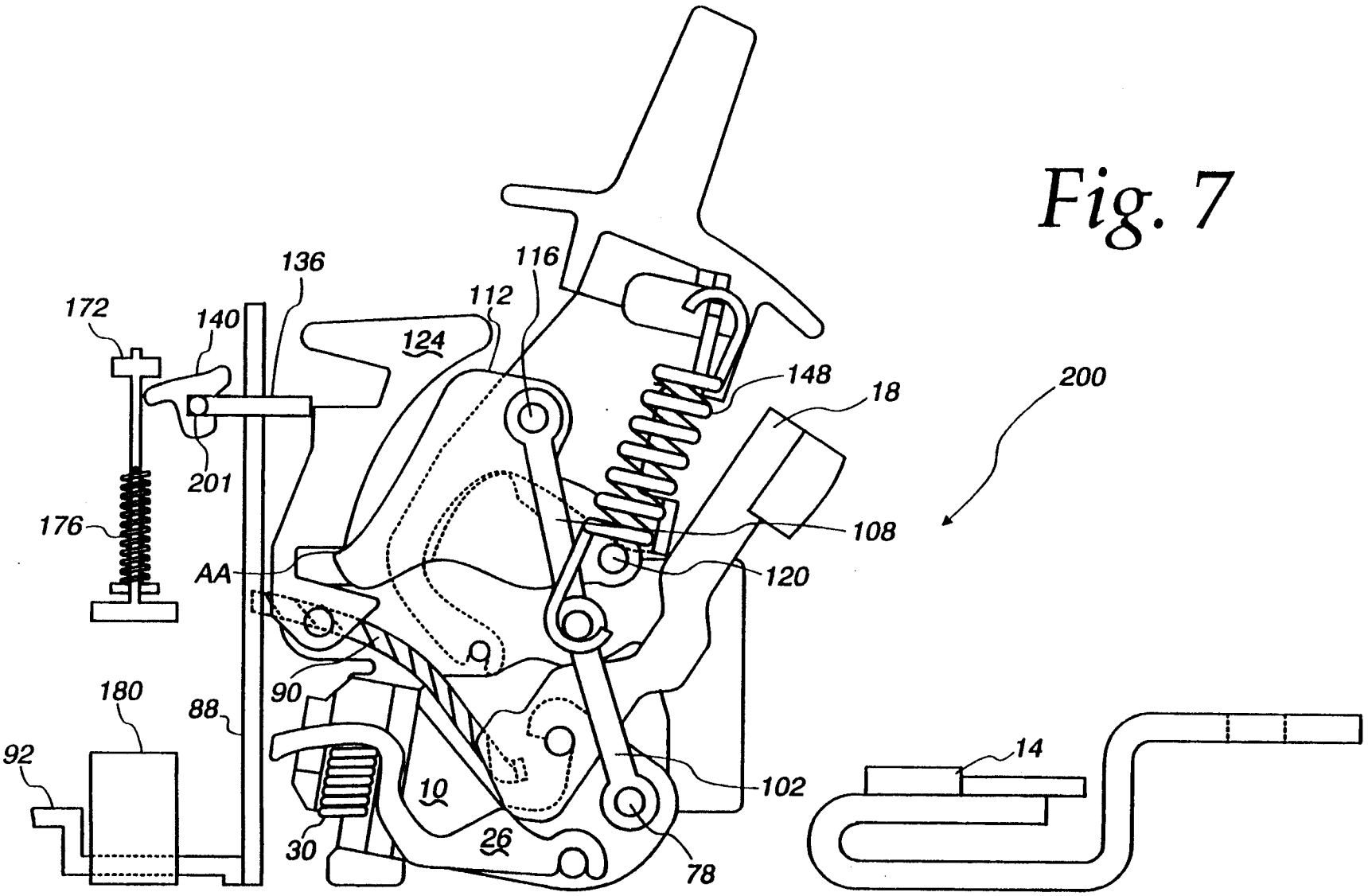
FIG. 7 is a side view of a tripping mechanism shown in the blown-open position.

The tripping mechanism 200 trips in two different ways. First, the tripping mechanism 200 trips due to high amounts of current (i) in the load terminal 92, typically referred to as a short-circuit or high impulse condition. When such a situation occurs, the contact arm 18 almost instantly "blows open," as shown in FIG. 1*c*, so that the tripping mechanism appears as shown in FIG. 7. Further in response to the short-circuit condition, the tripping mechanism 200 moves into the tripped position shown in FIG. 6. In particular, the high amount of current causes a high magnetic flux field around the yoke 180 which, in turn, pulls the magnetic armature 172 down toward the yoke 180. The magnetic armature 172 impacts the trip cross-bar 140, causing it to rotate counterclockwise. This impact causes the trip cross-bar 140 and the latch plate 136 to rotate counterclockwise about pivot point 201. When the latch plate 136 rotates counterclockwise, the latch plate 136 disengages the latch 124 by rotating upward into a niche 142 above the point 144. Also, the latch 124 is rotated counterclockwise by the action of the cradle 112 rotating clockwise. The cradle 112 is biased to rotate clockwise by the action of the springs 148 which pull the toggle pin 104 upwards forcing the cradle 112 to rotate around the cradle pivot point 120 due to the cradle's connection to the upper links 108 at the upper link cradle pin 116. The action of the toggle pin 104 moving upwards also raises the housing 10 and elongated contact arm 18 via the interconnection of the lower links 102 at the housing drive pin 78. While the tripping mechanism 200 moves from the blown-open position shown in FIG. 7 to the tripped position shown in FIG. 6, the contact arm 18 returns from the second contoured area 74 to the first contoured area 38 of the lever 26 so that the blade suspension mechanism moves from the blown-open position in FIG. 1*c* to the tripped position in FIG. 1*b*. In the event that the contact arm 18 does not return to the first contoured area 38, it does so when the tripping mechanism 200 is reset to the "on" position.

Second, the tripping mechanism 200 trips as a result of an overload condition, which typically occurs over a long period of time and which can cause the heating or melting of wire in circuits protected by the circuit breaker. In response to the overload condition, the tripping mechanism 200 moves into the tripped position shown in FIG. 6. A common situation in which an overload condition occurs is when several electrical devices are plugged into the same circuit wires, causing an above average amount of current to flow in the wires for a long period of time. When an overload condition occurs, the bimetal 88 heats up and flexes counterclockwise. The bimetal is composed of two dissimilar thermostat materials which are laminated or bonded together and which bend due to temperature increases. When the bimetal 88 bends counterclockwise, it impacts the trip cross-bar 140, causing the trip cross-bar 140 to rotate counterclockwise, and the tripping mechanism 200 trips in the manner previously described. Unlike the short-circuit condition, the blade suspension mechanism 100 does not first blow open in an overload condition. Instead, the contact arm 18 opens in response to the trip cross-bar 140 causing the cradle 112 to rotate upward, causing the housing 10 to move upward, causing the contact arm 18 to move upward.

In summary, the preferred embodiment has been designed to overcome the shortcomings of previous circuit breakers. These shortcomings have included inferior performance in terms of opening speed, reliability, and complexity. The great complexity of previous circuit breakers has limited the utilization of automated assembly, prevented late point assembly or field adjustments and has made servicing prohibitively expensive requiring the scrapping of entire circuit breakers upon malfunction. The preferred embodiment's substantially less complex design avoids the problems associated with complexity while at the same time operates with greater speed and higher reliability.

While the invention has been particularly shown and described with reference to certain embodiments, it will be recognized by those skilled in the art that modifications and changes may be made to the present invention. For example, the blade suspension mechanism could be modified to substitute a tension spring for the compression spring 30. While the compression spring 30 in FIGS. 1*a* through 1*c* is positioned below the lever 26, the tension spring is positioned above the lever 26 with one end connected to the lever spring end 46 and the other end connected to a portion of the housing 10 above the lever end 46. Each of these embodiments and obvious variations thereof is contemplated as falling within the spirit and scope of the claimed invention, which is set forth in the following claims.

What is claimed is:

1. A blade suspension assembly for a circuit breaker, comprising:

a first electrical contact;

an elongated contact arm having opposing ends and a second electrical contact adjacent one of the opposing ends for rotating about a pivot axis between a contacts-closed position and at least one contacts-open position with respect to said first electrical contact;

elongated lever means having opposing ends and a contoured surface therebetween, said contoured surface for supporting the elongated contact arm adjacent the other of said opposing ends of the elongated contact arm;

spring means for exerting a torque at one end of the elongated lever means so that the contoured surface exerts a force at the other of said opposing ends of the elongated contact arm about the pivot axis in the contacts-closed position and maintains the elongated contact arm in said at least one contacts-open position; and wherein said spring means exerts a force along a line of direction which does not intercept said elongated contact arm.

2. A blade suspension assembly for a circuit breaker, according to claim 1, wherein said at least one contacts-open position is a blown-open position.

3. A blade suspension assembly for a circuit breaker, according to claim 1, wherein said contoured surface includes a first area for supporting said elongated contact arm in the contacts-closed position and a second area for supporting said elongated contact arm in the contacts-open position.

4. A blade suspension assembly for a circuit breaker, according to claim 3, wherein said spring means exerts a force along a line of direction which does not intercept said elongated contact arm and wherein said first area of the contoured surface exerts a force along a line of direction which is substantially parallel to the line of direction of the force exerted by said spring means.

5. A blade suspension assembly for a circuit breaker, according to claim 3, wherein said second area of the contoured surface is closer to the other end of the elongated lever means than said one end of the elongated lever means.

6. A blade suspension assembly for a circuit breaker, according to claim 1, wherein said spring means includes a compression spring having a compression which increases as the elongated contact arm moves from the contact-closed position to the contacts-open position.

7. A blade suspension assembly for a circuit breaker, according to claim 1, wherein the elongated lever means rotates about another pivot axis located adjacent the other end of the elongated lever means.

8. A blade suspension assembly for a circuit breaker, according to claim 7, wherein said at least one contacts-open position includes a contacts-tripped position and wherein the elongated contact arm rotates about yet another pivot axis as the elongated contact arm moves from the contact-closed position to the contacts-tripped position.

9. A blade suspension assembly for a circuit breaker, comprising:

a first electrical contact;

an elongated contact arm having a second electrical contact adjacent one end of the elongated contact arm and movable about a pivot axis between a contacts-closed position and at least one contacts-open position with respect to said first electrical contact;

elongated lever means having a support surface for supporting the elongated contact arm adjacent another end of the elongated contact arm;

a compression spring;

a spring compartment having at least one wall and a bottom for containing the compression spring, a top opening for permitting sustained contact between one end of the compression spring and one end of the elongated lever means, and a lever means opening in said at least one wall such that said one end of the elongated lever means penetrates the lever means opening as the elongated contact arm moves from said contacts-closed position to the contacts-open position.

10. A blade suspension assembly for a circuit breaker, according to claim 9, wherein said spring compartment is part of a molded one-piece contact-arm support.

11. A blade suspension assembly for a circuit breaker, according to claim 10, wherein said pivot axis is supported within said molded one-piece contact-arm support.

12. A blade suspension assembly for a circuit breaker, comprising:

a first electrical contact:

an elongated contact arm having a second electrical contact adjacent one end of the elongated contact arm and movable about a first pivot axis between a contacts-closed position and at least one contacts-open position with respect to said first electrical contact:

a compression spring exerting a force along a line of direction which does not intercept the elongated contact arm;

an elongated lever having a first end adjacent a second pivot axis, a second end supported by the compression spring, and a contoured support surface between the first and second ends and supporting another end of the elongated contact arm;

wherein the compression spring exerts a force against the second end of the elongated lever so that the contoured support surface biases the other end of the elongated contact arm about the first pivot axis in the contacts-closed position during normal operation and in the contacts-open position in response to the contact arm moving to said at least one contacts-open position.

13. A blade suspension assembly for a multi-pole circuit breaker, comprising:

a molded one-piece contact-arm support;

a first electrical contact for each respective pole;

an elongated contact arm for each respective pole, each said elongated contact arm having opposing ends, a first pivot axis supported by said molded one-piece contact-arm support adjacent one of said opposing ends, and a second electrical contact adjacent the other of said opposing ends, wherein the elongated contact arm rotates about the first pivot axis between a contacts-closed position and at least one contacts-open position with respect to said first electrical contact;

elongated lever means for each respective pole, said elongated lever means having a first end, a second end, a second pivot axis adjacent the first end, and a contoured surface, located between the first and second ends, for supporting said one of said opposing ends of the elongated contact arm;

a compression spring exerting a force at said second end of the elongated lever means so that the contoured surface exerts a force at said one of said opposing ends of the elongated contact arm thereby biasing the elongated contact arm about the first pivot axis in the contacts-closed position and maintaining the elongated contact arm in said at least one contacts-open position; and wherein said compression spring exerts a force along a line of direction which does not intercept said elongated contact arm.

14. A blade suspension assembly for a multi-pole circuit breaker, according to claim 13, wherein said molded one-piece contact-arm support includes a spring compartment for containing the compression spring.

15. A blade suspension assembly for a multi-pole circuit breaker, according to claim 14, wherein the spring compartment includes a top opening to permit sustained contact between one end of the compression spring and said second end of the elongated lever means.

16. A blade suspension assembly for a multi-pole circuit breaker, according to claim 15, wherein the spring compartment further includes a side opening into which said second end of the elongated lever means penetrates as the elongated contact arm moves from said contacts-closed position to said at least one contacts-open position.

17. A blade suspension assembly for a multi-pole circuit breaker, according to claim 13, wherein said molded one-piece contact-arm support includes first and second containment means for respectively containing said first and second pivot axes.

18. A blade suspension assembly for a multi-pole circuit breaker, according to claim 17, wherein at least one of said first and second pivot axes includes a pin which is contained, at least in part, by the respective one of said first and second containment means.

19. A blade suspension assembly for a multi-pole circuit breaker, according to claim 17, wherein at least one of said first and second pivot axes is molded as part of said molded one-piece contact-arm support.

* * * * *